US007900453B1

(12) United States Patent
Lynch et al.

(10) Patent No.: US 7,900,453 B1
(45) Date of Patent: Mar. 8, 2011

(54) METAL FUEL COMBUSTION AND ENERGY CONVERSION SYSTEM

(75) Inventors: William A. Lynch, Cohasset, MA (US); Neal A. Sondergaard, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 683 days.

(21) Appl. No.: 11/900,142

(22) Filed: Sep. 5, 2007

Related U.S. Application Data

(63) Continuation-in-part of application No. 11/272,424, filed on Nov. 8, 2005, now Pat. No. 7,430,866.

(51) Int. Cl.
*F01K 13/00* (2006.01)

(52) U.S. Cl. ..... 60/645; 60/670

(58) Field of Classification Search ..... 60/645, 60/670

See application file for complete search history.

(56) References Cited

U.S. PATENT DOCUMENTS

| | | | | |
|---|---|---|---|---|
| 3,304,205 | A * | 2/1967 | Lord et al. | 136/208 |
| 3,749,079 | A * | 7/1973 | Gudmand-Hoyer | 126/116 R |
| 3,969,891 | A * | 7/1976 | Aguet | 60/39.182 |
| 4,029,035 | A * | 6/1977 | German | 114/67 A |
| 5,007,973 | A * | 4/1991 | Trapp et al. | 149/109.6 |
| 5,356,487 | A * | 10/1994 | Goldstein et al. | 136/253 |
| 5,432,090 | A * | 7/1995 | Tanaka et al. | 436/79 |
| 7,275,644 | B2 * | 10/2007 | Ness et al. | 209/474 |
| 7,430,866 | B1 * | 10/2008 | Lynch et al. | 60/645 |

* cited by examiner

*Primary Examiner* — Hoang M Nguyen
(74) *Attorney, Agent, or Firm* — Dave A. Ghatt

(57) ABSTRACT

A metal fuel combustion system and method for producing energy. The energy may be used to drive a water vessel such as a submarine. The system and method comprises a combustion device having inner and outer combustion chambers. The metal fuel comprises aluminum, magnesium, and silicon, and is preferably in the form $Mg_2Al_4Si_5$, and is preferably burnt using water as an oxidant. The byproduct of and the metal oxide byproduct is $Mg_2Al_4Si_5O_{18}$, which has an appearance and consistency similar to basaltic sea sand. In addition to the combustion device, the system may include additional energy producing elements such as fuel cells, thermoelectric cells, and photovoltaic cells.

19 Claims, 4 Drawing Sheets

METAL FUEL COMBUSTION AND ENERGY CONVERSION SYSTEM

CROSS-REFERENCE TO RELATED APPLICATIONS

This application is continuation in part to related to U.S. nonprovisional patent application Ser. No. 11/272,424 filing date Nov. 8, 2005, now U.S. Pat. No. 7,430,866 hereby incorporated herein by reference, entitled "Air-Independent Fuel Combustion Energy Conversion," joint inventors William A. Lynch and Neal A. Sondergaard.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for providing energy conversion, more particularly, to a combustion system that utilizes the burning of a solid metal fuel to produce energy, such as electrical or mechanical energy, which may be used to drive a water vessel such as a submarine.

BACKGROUND

Combustion systems may be used to generate energy to propel commercial and military sea vessels. In combustion systems, fuels typically react with oxidants, such as oxygen or fluorine. When oxygen is utilized as the oxidant, the oxygen is typically obtained from atmospheric air. In combustion systems for subsurface vehicles such as submarines, it would be advantageous to utilize air-independent oxidation sources.

Combustion byproducts discharged from the combustion systems typically include carbon dioxide ($CO_2$) and other chemicals. These common combustion byproducts are readily detectable thereby making vehicles utilizing these combustion systems detectable as well. This is particularly undesired in military vehicles, such as submarines wherein the detection of the vessel may compromise the health and safety of its occupants.

Solid light-weight fuels such as aluminum and magnesium powder mixtures may be employed in combustion systems. The aluminum type fuel mixture advantageously provides an excellent energy density as a result of the combustion. However, its associated combustion discharge byproduct forms a slag responsible for agglomerating and clogging problems with respect to the exhaust port of the combustor. The magnesium type of fuel mixture is advantageously more readily combustible under a lower boiling point than the aluminum type, but provides for a significantly lower energy density. It is desired to have a combustion system that is designed to utilize a combination of aluminum and magnesium that provides the advantages associated with aluminum and magnesium fuel mixtures while avoiding the latter referred to problems associated therewith. Also, it is desired that the combustion system has the ability to be air-independent. Additionally, it is desired to have a combustion system that produces a byproduct having a non-detectable signature.

SUMMARY

In one aspect, the invention is a metal fuel combustion system having a metal fuel mixture, an oxidant, and a water source. The system further includes a combustion device for combusting the metal fuel mixture, the combustion device having an inner chamber and an outer chamber. In this aspect, the invention also has at least one fluid inlet attached to the outer chamber for directing water from the water source into the outer chamber, and at least one oxidant inlet attached to the inner chamber for directing the oxidant into the inner chamber. In this aspect, the system further includes at least one fuel feeder having the metal fuel mixture, the fuel feeder feeding the metal fuel mixture into the inner chamber of the combustion device. Additionally, the system includes at least one first outlet attached to the outer chamber for discharging steam, and at least one second outlet attached to the inner chamber for discharging hydrogen and steam. A byproduct collector is also included, the byproduct collector having a processing device for processing the byproduct.

In another aspect, the invention is a combustion arrangement for processing a metal fuel mixture. The combustion arrangement includes a combustor having an inner chamber and an outer chamber, the inner chamber inside the outer chamber. In this aspect, the arrangement also has a fluid inlet attached to the outer chamber for directing water from the water source into the outer chamber, and an oxidant inlet attached to the inner chamber for directing one or more oxidants into the inner chamber. The combustion arrangement also has a fuel feeder for feeding the metal fuel mixture, the fuel feeder feeding the metal fuel mixture into the inner chamber of the combustion device. A first outlet attached to the outer chamber for discharging steam is also included, and a second outlet attached to the inner chamber for discharging hydrogen and steam. In this aspect, the invention further includes a byproduct collector, the byproduct collector having a processing device for processing the byproduct.

In yet another aspect, the invention is an energy conversion and storage method. The method is directed towards a combustion arrangement comprising a combustor having an inner chamber and an outer chamber, the inner chamber inside the outer chamber, a turbine communicating with the outer chamber, and a byproduct collector attached to the inner chamber. In this aspect, the energy conversion and storage method includes the feeding of liquid water into the outer chamber of the combustor and the feeding of a metal fuel into the inner chamber of the combustor, the metal fuel comprising silicon, magnesium, and aluminum. The method further includes the feeding of an oxidant into the inner chamber of the combustor, the burning of the metal fuel creating steam in the outer chamber and creating hydrogen, steam, and metal oxide byproducts in the inner chamber, and the directing of the steam from the outer chamber into the turbine. Additionally, the method includes the expelling of the hydrogen byproduct from the inner chamber, and the depositing of the metal oxide byproduct from the inner chamber into the byproduct collector.

BRIEF DESCRIPTION OF THE DRAWINGS

Other features will be apparent from the description, the drawings, and the claims.

DETAILED DESCRIPTION

Figure 1:
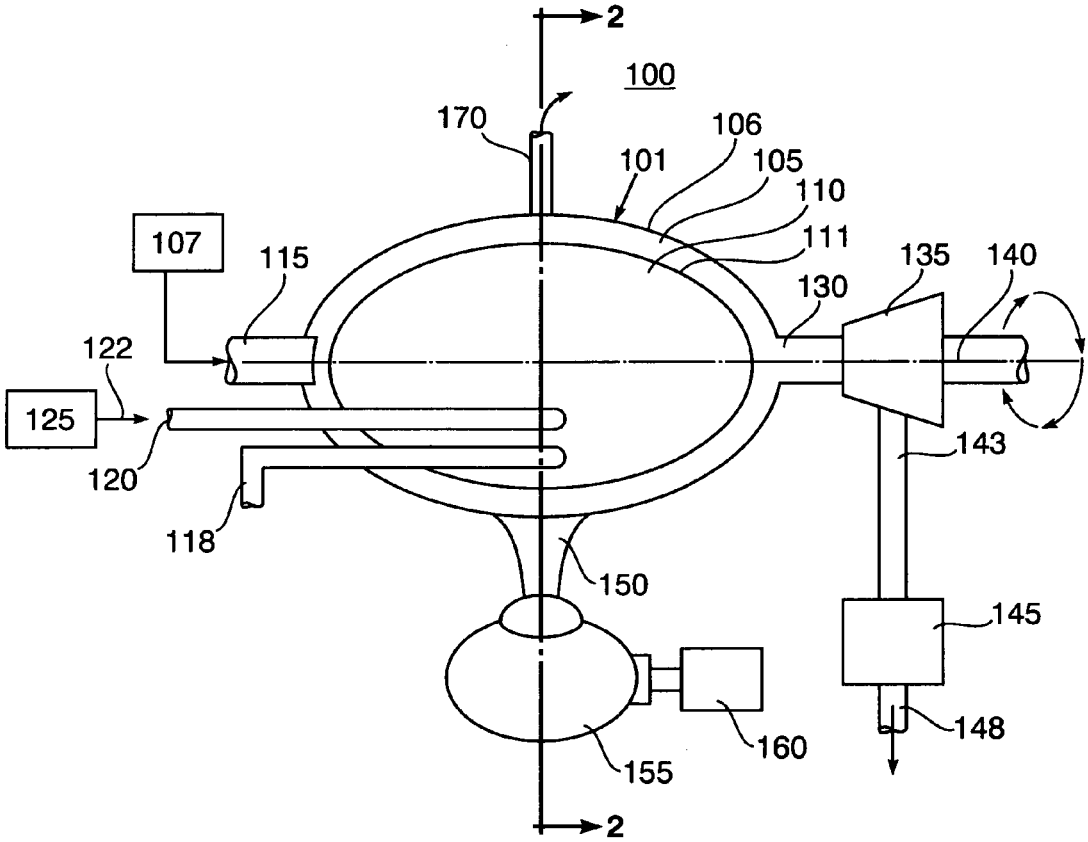
FIG. 1 is a perspective view of a combustion system according to an embodiment of the invention.

FIG. 1 is a perspective view of a combustion system 100 according to an embodiment of the invention. The combustion system 100 may be employed in water vessels, such as ships or submarines. FIG. 1 shows a combustion device 101 for burning a lightweight metal fuel mixture. The combustion device 101 includes an outer chamber 105 surrounding an inner chamber 110. The outer chamber having an outer shell wall 106 and the inner chamber having an inner shell wall 111. The combustion system 100 includes a first inlet 115 that is connected to the outer chamber 105 for directing liquid water into the outer chamber. The water may be obtained from a water source 107. The water source may contain purified and de-ionized sea-water. The combustion system 100 also includes second and third inlets 118 and 120.

As shown in FIG. 1, inlet 118 extends through the outer chamber 105 and extends into the inner chamber 110. Inlet 118 is used to direct an oxidant into the inner chamber. The oxidant used is preferably water, but may also be other known oxidants such as liquid oxygen, chlorine or other halides. When water is used as the oxidant, the water may be fed from the water source 107 to the inlet 118. The water source 107 may have different connectors for feeding water to the inlets 105 and 118. These connectors may also include pumps and valves for varying the pressure of the water fed to the inlets 105 and 118.

FIG. 1 also shows the inlet 120 extending through the outer chamber 105 and into the inner chamber 110. The inlet 120 is used to feed the lightweight metal fuel mixture 122 into the inner chamber 110. The fuel mixture 122 comprises magnesium, aluminum, and silicon. The fuel 122 is preferably a pre cordierite alloy with a net composition such as $Mg_2Al_4Si_5$. This metal fuel mixture 122 has a significantly lower melting point than any of the pure oxides. The metal fuel mixture 122 may comprise for example, a wire made up of a thin walled aluminum tube containing a mixture of silicon, magnesium and possibly aluminum in its core. A sample may be made by drawing molten magnalium under inert atmospheric conditions into an aluminum tube containing silicon powder under a vacuum. In production, the metal fuel mixture 122 may be made by drawing through dies and winding on a large take up spool. FIG. 1 illustrates a fuel feeding device 125, which may be a servo driven feeding spool from which the fuel may be fed into the inlet 120 and subsequently into the combustor device 101. Alternatively, the metal fuel mixture 122 may be prepared as pellets, powder, or as a liquid. The pellets could be similar to the fuel wire in composition and structure. Depending on the type of fuel mixture, i.e., pellets, powder, or liquid, other fuel feeding devices may be employed.

The combustion system 100 further includes a first outlet, an exhaust steam line 130, extending from the outer chamber 105. The exhaust steam line 130 is connected to a turbine 135, the steam line 130 directing steam from the outer chamber 105 to the turbine 135. The turbine 135 includes a turbine exhaust 143 that extends to a condenser 145, the condenser for converting the steam into liquid water, which may be redirected to the water source 107. The turbine 135 may be used to convert the energy produced by the combustion device 101 into mechanical and electrical energy or a combination thereof.

The combustion system 100 further includes a byproduct exhaust funnel 150 for channeling the combustion byproduct into a byproduct collector 155. Combustion temperatures may be manipulated to produce a solid or a liquid byproduct. A byproduct processor 160 may be attached to the byproduct collector 155, the processor for processing the byproduct. As shown in FIG. 1, the system 100 also includes a second outlet 170 for discharging hydrogen and steam from the inner chamber 110.

In operation, the combustion system 100 may be used to provide energy to water vessels, including submarines and the like. The system may operate as follows. Liquid water is fed into the outer chamber 101 of the combustion device via inlet 105. The water may be supplied by the water source 107. Liquid water is fed into the inner combustion chamber 110 via the inlet 118. This water may also be supplied by the water source 107. Metal fuel mixture 122, is fed into the inner combustion chamber by feeder 125. In one embodiment, the metal fuel mixture may be wrapped around the reel of a servo driven spool, which feeds the fuel into the inner combustion chamber 110, via inlet 120. The fuel is burnt in the water. As outlined above, the metal fuel mixture is preferably $Mg_2Al_4Si_5$. When $Mg_2Al_4Si_5$ is used as the fuel, the combustion byproduct is the eutectic cordierite oxide, $Mg_2Al_4Si_5O_{18}$, which passes through funnel 150, into the byproduct collector 155. The inner chamber may be coated with an inner lining material such as rhenium, to prevent damage from the high temperatures associated with combustion.

According to an embodiment, the $Mg_2Al_4Si_5$ burns at a lower temperature than individual components magnesium aluminum, and silicon, and the byproduct is more readily gathered in the collector 155. The combustion byproduct, mineral cordierite, has a lower melting point of 1467° C. compared with 1713° C., 2054° C., and 2826° C. for silicon, aluminum, and magnesium respectively. The combustion temperature may be manipulated to enable the collecting of the byproduct as a liquid rather than a solid, thereby avoiding the undesired slag agglomeration that occurs at higher melting points. The liquid byproduct is processed in the processor 160, which may include a spray nozzle, to solidify the $Mg_2Al_4Si_5O_{18}$ byproduct. The byproduct could be solidified as droplets or pellets. These could be crushed into a sand-like substance, which is similar in composition to basalt oceanic crust. The composition and appearance of the byproduct is advantageous because its emission should not produce a detectable signature or have an adverse environmental impact.

The burning of the metal fuel mixture also produces gaseous hydrogen and steam, which is directed out of the inner chamber 110 via exhaust 170. A separating device such as a steam trap may be used to separate the water vapor from the hydrogen. The hydrogen may be stored for subsequent use, and the water may be recycled to the water source 107 for repeated use in the system 100.

The heat created by the reaction in the inner chamber 110 turns the liquid water in the outer chamber 105 into steam. This steam exits the out chamber 110 via the first outlet, exhaust steam line 130. The steam is fed to the turbine 140, which converts the thermal energy from the steam into mechanical energy. The mechanical energy may drive one or more propellers of the water vessel. Alternatively, a generator may be used to convert the mechanical energy from the turbine, into electrical energy. This electrical energy may be used to drive the water vessel, or may be stored in a storage device.

It should be noted that although FIG. 1 illustrates only three inlets and two outlets, the combustion system 100 may include as many inlets and outlets as desired. For example, the system 100 may include multiple inlets for feeding fuels, multiple inlets for feeding oxidant, and multiple inlets for feeding steam. Similarly, the system may have a plurality of outlets for disbursing the hydrogen and steam from the inner chamber, and/or multiple outlets for discharging the steam from the outer chamber.

Figure 2:
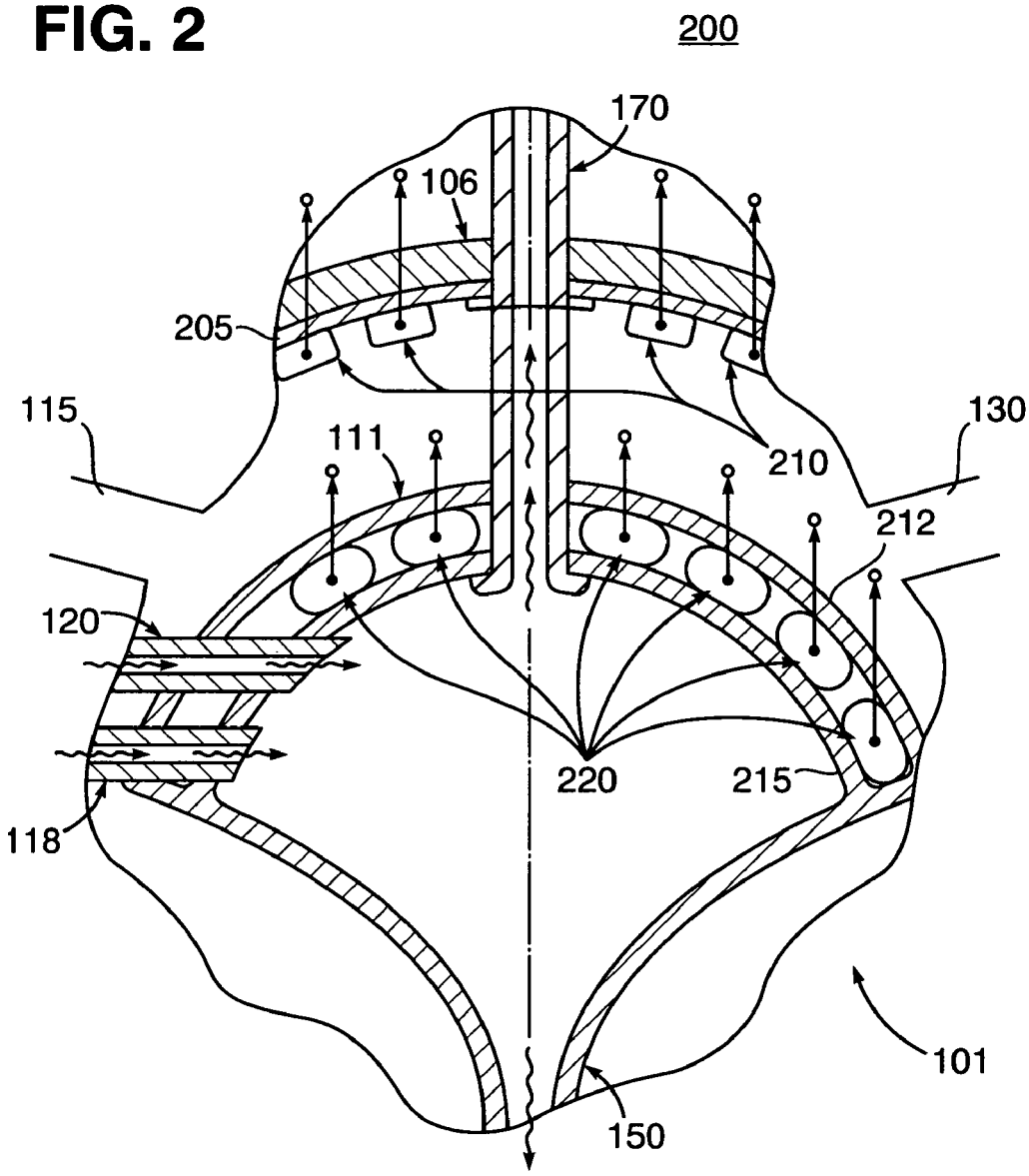
FIG. 2 is a perspective view taken substantially through a plane indicated by section line 2-2 in FIG. 1, illustrating an exemplary arrangement for a combustion device.

FIG. 2 is a perspective view taken substantially through a plane indicated by section line 2-2 in FIG. 1, showing an arrangement 200 for the combustion device 101, according to an embodiment of the invention. The arrangement 200 provides additional means for producing energy in a combustion system. In operation, the arrangement 200 may be used to provide energy to water vessels, including submarines and the like, by utilizing the heat and luminous/radiant energy produced in the combustion chamber.

FIG. 2 shows the combustion device 101 having the outer shell wall 106 and the inner shell wall 111. As shown in FIG. 2, the outer shell wall 106 is internally coated with an electrically insulating protective lining 205, such as silicon rubber. A protective lining such as silicon rubber prevents corrosion caused by the high pressure hot temperature steam conditions within the outer chamber. A plurality of photovoltaic materials 210 having photovoltaic cells are internally mounted on the protective lining 205. The arrangement 200 may include one or more layers of photovoltaic materials on the lining 205. The lining 205 may also serve as an adhesive for attachment of the photovoltaic materials 210. The photovoltaic cells convert radiant energy produced by the combustion chamber, directly into electrical energy, which may be delivered for use outside of the arrangement 200.

As shown in FIG. 2, the inner shell wall 111 comprises a double wall structure comprising single walls 212 and 215, with the wall 212 defining the outer boundary of the inner chamber. FIG. 2 further shows a plurality of thermoelectric materials 220 having thermoelectric cells sandwiched between the combustor shell 212 and 215. The arrangement 200 may include one or more layers of thermoelectric materials between the walls 212 and 215. The thermoelectric cells are provided to convert some of the combustion heat directly into electrical energy. The electrical energy may be delivered for use outside of the arrangement 200. The wall 212 may be composed of a refractory material such as rhenium which has the ability to act as shield, which protects the cells and wall 215 from excessive heat imposed by direct contact with the flame or from abrasive damage associated with the combustion products.

Figure 3:
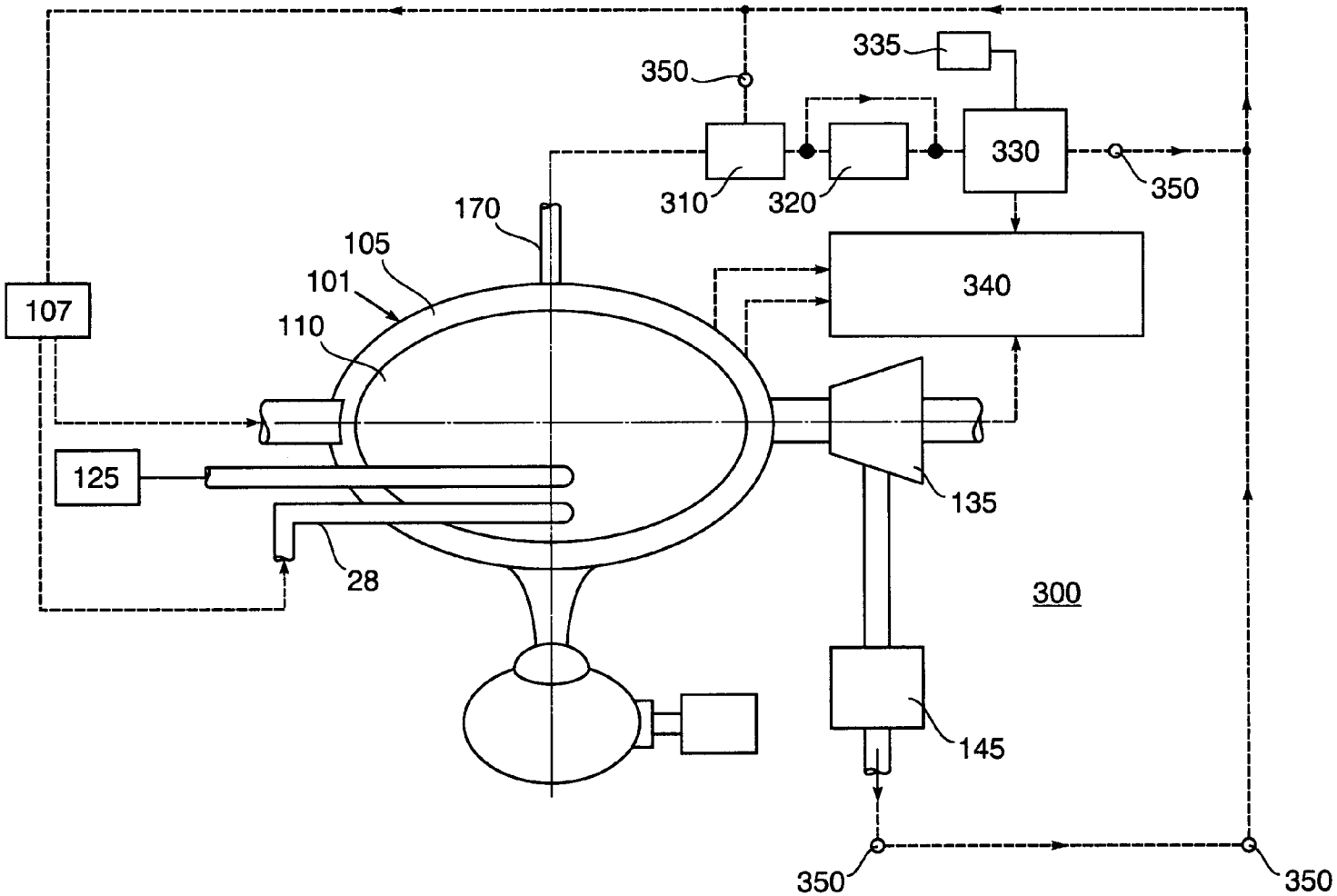
FIG. 3 is a perspective view of a combustion system according to an embodiment of the invention.

FIG. 3 is a perspective view of a combustion system 300 according to an embodiment of the invention. As shown, FIG. 3 includes the general system of FIG. 1, i.e., a combustion system having a combustion device 101 with outer and inner chambers, 105 and 110 respectively. The combustion system 300 of FIG. 3 also includes the outlet 170 for expelling hydrogen and steam, two of the byproducts of the combustion of $Mg_2Al_4Si_5$ in water. As illustrated, the outlet leads to a separation device 310, such as a steam trap, which separates the steam from the hydrogen. The steam is preferably separated as liquid water, which may be fed back to the water source 107 for reuse. The separated hydrogen may be fed into a fuel cell 330. Prior to being fed into the fuel cell, the hydrogen may be temporarily stored in a hydrogen storage device 320.

The fuel cell 330 may be a hydrogen-oxygen fuel cell, which requires a liquid oxygen source 335. The source 335 may also be compressed oxygen gas. Perchlorates such as lithium perchlorate may be utilized to provide oxygen. The fuel cell 330 produces electric energy with water as a byproduct, via an electrochemical energy conversion process. As shown in FIG. 3, the water byproduct from the fuel cell may be directed to the water source 107. Because the hydrogen fuel for the fuel cell may be stored in a storage device 320, the fuel cell 330 may be operated independent of the combustion device 101, and may be used according to energy demands.

The arrangement 300 may also include an energy storage device 340 for storing energy produced from combustion. The energy storage device 340 may store electrical energy produced by the fuel cell 330 and/or the turbine 135. In situations where the combustion arrangement 200 is utilized, the storage device 340 may also store electrical energy produced by the photovoltaic and the thermoelectric cells. The energy storage device may comprise lithium ion cells, or the like, and may be a single device, or it may comprise a plurality of different electrical energy storage devices. The arrangement 300 may also include one or more pumps 350, for regulating the flow of water from elements 145, 310, and 330, back to the water source 107.

Figure 4:
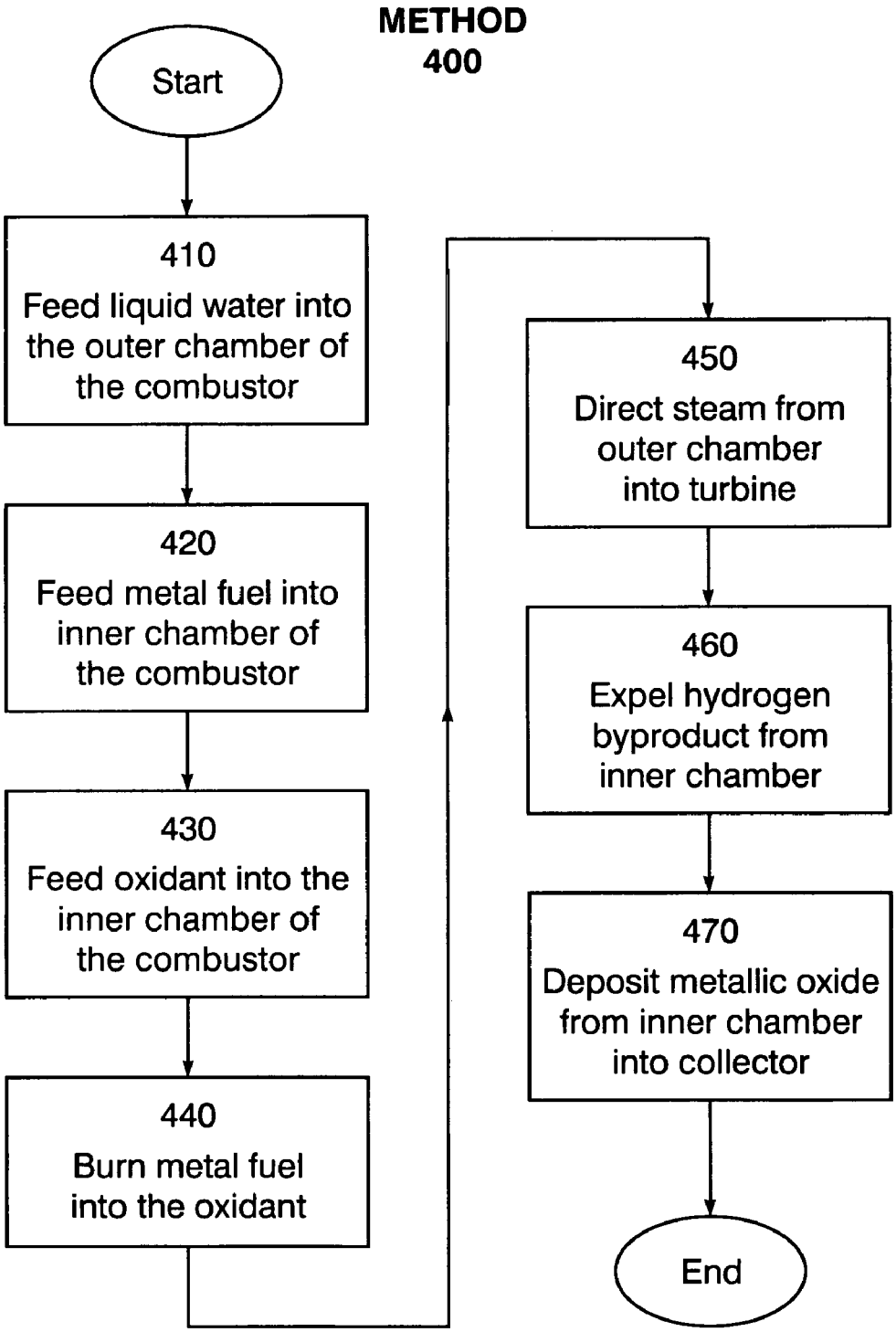
FIG. 4 is a flow chart of an energy conversion and storage method according to an embodiment of the invention.

FIG. 4 is a flow chart of an energy conversion and storage method 400 according to an embodiment of the invention. The method 400 is directed towards combustion systems and arrangements similar to those illustrated in FIGS. 1-3. For example, the method may be directed to a combustion system having a combustion device 101 with an inner chamber 110 and an outer chamber 105 as shown in FIG. 1. Additionally, the system may include a turbine 135 communicating with the outer chamber 105, and a byproduct collector 155 attached to the inner chamber. The method 400 comprises step 410, the feeding of liquid water into the outer chamber of the combustor. This process has been outlined in the description of the embodiments of FIGS. 1 and 3, wherein liquid water is fed into the outer chamber via an inlet.

Step 420 is the feeding of a metal fuel into the inner chamber of the combustor, the metal fuel comprising magnesium, aluminum, and silicon. Again, this process has been outlined in the description of the embodiments of FIGS. 1 and 3. As outlined above, the metal fuel may be fed into the inner chamber via a servo drive spool. Step 430 is the feeding of an oxidant into the inner chamber of the combustor. The oxidant is preferably water fed via an inlet, as illustrated in FIGS. 1-3. It should be noted that steps 410, 420, and 430 may be performed in any preferred order, and may not be performed in the order illustrated in FIG. 4.

Step 440 is the burning of the metal fuel in the inner chamber of the combustor. The burning produces heat which energizes the transformation of liquid water into steam in the outer chamber. Additionally, the reaction in the inner chamber creates hydrogen, steam, and metal oxide as byproducts in the inner chamber. At step 450, the steam from the outer chamber is directed into the turbine, as shown in FIGS. 1 and 2. At step 460, the hydrogen byproduct is expelled from the inner chamber via an outlet. As shown in FIG. 3, the hydrogen may be stored and/or directed into a fuel cell for producing more energy. Step 470 is the depositing of the metal oxide byproduct from the inner chamber into the byproduct collector.

A number of exemplary implementations have been described. Nevertheless, it will be understood that various modifications may be made. For example, suitable results may be achieved if the steps of described techniques are performed in a different order and/or if components in a described component, system, architecture, or devices are combined in a different manner and/or replaced or supplemented by other components. Accordingly, other implementations are within the scope of the following claims.

What is claimed is:

1. A metal fuel combustion system having:

a metal fuel mixture;

an oxidant;

a water source having water;

a combustion device for combusting the metal fuel mixture, the combustion device having an inner chamber and an outer chamber;

at least one fluid inlet attached to the outer chamber for directing the water from the water source into the outer chamber;

at least one oxidant inlet attached to the inner chamber for directing the oxidant into the inner chamber;

at least one fuel feeder having the metal fuel mixture, the fuel feeder feeding the metal fuel mixture into the inner chamber of the combustion device;

at least one first outlet attached to the outer chamber for discharging steam;

at least one second outlet attached to the inner chamber for discharging hydrogen and steam;

a byproduct collector, the byproduct collector having a processing device for processing the byproduct;

a turbine downstream of the combustion device, communicating with the first outlet to receive steam from the first outlet to extract energy from the steam;

wherein the combustion device includes:

an outer wall defining the outer boundary of the outer chamber;

one or more layers of photovoltaic materials lining the inner side of the outer wall, the one or more layers of photovoltaic materials for converting light energy into electrical energy;

an inner wall defining the outer boundary of the inner chamber, wherein the inner wall comprises a two-wall structure having a first wall and a spaced apart heat-shield wall; and one or more layers of thermoelectric materials positioned between the first wall and the heat-shield wall, the one or more layers of thermoelectric materials for converting heat energy to electrical energy.

2. The metal fuel combustion system of claim 1, wherein the metal fuel comprises magnesium, aluminum, and silicon.

3. The metal fuel combustion system of claim 2, wherein the metal fuel is $Mg_2Al_4Si_5$, and the oxidant is water or a halogen.

4. The metal fuel combustion system of claim 3, wherein the $Mg_2Al_4Si_5$ is formed in a wire-like configuration, and wherein the fuel feeder is a servo driven spool, with the $Mg_2Al_4Si_5$ wrapped around the spool.

5. The metal fuel combustion system of claim 4, further including a fuel cell downstream of the combustion device, communicating with the second outlet to receive hydrogen from the second outlet to produce electricity.

6. The metal fuel combustion system of claim 5, further including an energy storage device for storing energy produced by the fuel cell, the photovoltaic materials, and the thermoelectric materials.

7. The metal fuel combustion system of claim 6, wherein the at least one fluid inlet is a plurality of fluid inlets, the at least one oxidant inlet is a plurality of oxidant inlets, and the at least one fuel feeder inlet is a plurality of fuel feeder inlets.

8. A combustion arrangement for processing a metal fuel mixture comprising:

a combustor having an inner chamber and an outer chamber, the inner chamber inside the outer chamber;

a fluid inlet attached to the outer chamber for directing water from the water source into the outer chamber;

an oxidant inlet attached to the inner chamber for directing one or more oxidants into the inner chamber;

a fuel feeder for feeding the metal fuel mixture, the fuel feeder feeding the metal fuel mixture into the inner chamber of the combustion device;

a first outlet attached to the outer chamber for discharging steam;

a second outlet attached to the inner chamber for discharging hydrogen and steam;

a byproduct collector, the byproduct collector having a processing device for processing the byproduct;

an outer wall defining the outer boundary of the outer chamber;

one or more layers of photovoltaic cells lining the inner side of the outer wall, the one or more layers of photovoltaic cells for converting light energy into electrical energy;

an inner wall defining the outer boundary of the inner chamber, wherein the inner wall comprises two spaced apart shell layers; and one or more layers of thermoelectric cells positioned between the two spaced apart shell layers, the one or more layers of thermoelectric cells for converting heat energy to electrical energy.

9. The combustion arrangement of claim 8, further including a turbine communicating with the first outlet to receive steam from the first outlet to extract energy from the steam, and a fuel cell communicating with the second outlet to receive hydrogen from the second outlet to produce electricity.

10. The combustion arrangement of claim 9, wherein the fuel feeder is a servo driven spool, for feeding the metal fuel wrapped around the spool.

11. In a combustion arrangement comprising a combustor having an inner chamber having an inner chamber wall comprising two spaced apart shell layers and an outer chamber having an outer chamber wall, the inner chamber inside the outer chamber, a turbine communicating with the outer chamber, and a byproduct collector attached to the inner chamber, wherein the combustion arrangement further includes one or more layers of photovoltaic materials lining an inner side of the outer chamber wall and one or more layers of thermoelectric materials positioned between the two spaced apart shell layers, the combustion arrangement further comprising a fuel cell communicating with the inner chamber, an energy conversion and storage method comprising:

feeding liquid water into the outer chamber of the combustor;

feeding a metal fuel into the inner chamber of the combustor, the metal fuel comprising magnesium, aluminum, and silicon;

feeding an oxidant into the inner chamber of the combustor;

burning the metal fuel creating steam in the outer chamber and creating hydrogen, steam, and metal oxide byproducts in the inner chamber;

directing the steam from the outer chamber into the turbine;

expelling the hydrogen byproduct from the inner chamber;

depositing the metal oxide byproduct from the inner chamber into the byproduct collector;

using the photovoltaic materials to convert light energy into electrical energy;

using the thermoelectric materials to convert heat energy into electrical energy; and directing the expelled hydrogen from the inner chamber into the fuel cell.

12. The energy conversion and storage method of claim 11, wherein the metal fuel is $Mg_2Al_4Si_5$, the oxidant is water, and the metal oxide byproduct is $Mg_2Al_4Si_5O_{18}$.

13. The energy conversion and storage method of claim 12, wherein the $Mg_2Al_4Si_5$ is provided in a wire-like configuration on a spool, the spool being driven to feed the $Mg_2Al_4Si_5$ into the inner chamber of the combustor.

14. The energy conversion and storage method of claim 12, wherein the $Mg_2Al_4Si_5O_{18}$ is cooled with a water-spray to assume the consistency and appearance of sea sand.

15. The energy conversion and storage method of claim 14, wherein before the hydrogen is directed to the fuel cell, the hydrogen is stored in a storage device.

16. The energy conversion and storage method of claim 12, wherein the $Mg_2Al_4Si_5O_{18}$ is solidified as pellets.

17. The metal fuel combustion system of claim 6, further comprising:

a separation device; and a hydrogen storage device, wherein each of the separation device, the hydrogen storage device, and the fuel cell, are downstream of the at least one second outlet, and wherein the separator and the fuel cell are both connected to the water source so that water from the separation device and the fuel cell may be fed to the water source.

18. The metal fuel combustion system of claim 17, further including a condenser downstream of the turbine for converting steam into liquid water, the condenser connected to the water source for feeding the liquid water from the condenser to the water source.

19. The combustion arrangement of claim 10, further comprising: a separation device; and a hydrogen storage device, wherein each of the separation device, the hydrogen storage device, and the fuel cell, are downstream of the second outlet; and a condenser downstream of the turbine for converting steam into liquid water.

* * * * *